United States Patent [19]

Düpree

[11] 4,173,380

[45] Nov. 6, 1979

[54] DRAWER ASSEMBLAGE

[76] Inventor: Hans-Werner Düpree, Osnabrücker Landstrasse 154, 4830 Gütersloh 11, Fed. Rep. of Germany

[21] Appl. No.: 881,858

[22] Filed: Feb. 27, 1978

[30] Foreign Application Priority Data

Feb. 25, 1977 [DE] Fed. Rep. of Germany ..... 2708167

[51] Int. Cl.[2] ..... A47B 88/00

[52] U.S. Cl. ..... 312/330 R; 312/341 NR; 312/346; 308/3.6

[58] Field of Search ..... 312/330 R, 330 SM, 341 NR, 312/343, 346; 308/3.6

[56] References Cited

U.S. PATENT DOCUMENTS

| | | | |
|---|---|---|---|
| 2,751,272 | 6/1956 | Hutzelman | 312/346 |
| 3,377,115 | 4/1968 | Hansen et al. | 312/330 R |
| 3,386,784 | 6/1968 | Oppenhuizen et al. | 308/3.6 |
| 3,439,967 | 4/1969 | Taylor | 312/330 |
| 3,509,665 | 5/1970 | Bartlett et al. | 312/330 |
| 3,603,659 | 9/1971 | Richardson et al. | 312/330 R |
| 3,716,283 | 2/1973 | Little | 312/330 |
| 3,826,554 | 7/1974 | Cornell | 312/330 R |

FOREIGN PATENT DOCUMENTS

| | | | |
|---|---|---|---|
| 1957878 | 5/1971 | Fed. Rep. of Germany | 312/330 R |

*Primary Examiner*—Victor N. Sakran
*Attorney, Agent, or Firm*—Charles E. Baxley

[57] ABSTRACT

A drawer assemblage includes a one piece drawer member having a bottom from which upwardly extend front, rear and side walls. The side walls are double having inner and outer walls in mutually parallel spaced relation. Inserted in the space between each pair of these walls is a ribbed ledge member having between ribs longitudinally extending panels which alternately abut the inner and outer walls. The bottom portion of the ledge member which extends below the outer walls is provided with an outwardly facing horizontal insertion groove for accommodating guide means.

23 Claims, 21 Drawing Figures

DRAWER ASSEMBLAGE

BACKGROUND OF THE INVENTION

This invention pertains to drawers which are made from plastic in a single piece by injection molding and more particularly to such drawers having double walled sides with the space between the double walls of the sides being accessible from the bottom and stiffened with transverse ribs. The drawer is furthermore provided at its lower end with an insertion ledge which has on its bottom the guidepath for rollers, and the front of the drawer is provided with attachments for the application of a front facing.

Single piece drawers have proven very suitable in various respects. They are already complete upon manufacture and require no further assembling. They have proven very suitable in particular for kitchens, for articles or furniture used in the medical field etc., since they are easy to keep clean, and, in view of their method of manufacture, have rounded corners and edges in which dirt cannot accumulate.

Previously known drawers of this type, however, have several disadvantages. Since for various reasons, and particularly reasons of manufacture, these drawers must have uniformly thick walls, and the wall thicknesses must furthermore not be too great, the result is, even with a design which takes these facts into consideration, that, for instance, the resistance to warping and in general the dimensional stability are not sufficient and leave something to be desired. Drawers are heretofore known in which the guides have been developed separately and, in particular, also stiffened with transverse ribs. Of course, doubling has been effected for purposes of stiffening, particularly that of the side walls, by extending them from their top edge downward, approximately in the form of a skirt. In addition stiffening ribs have also already been developed in the space produced thereby. Other drawer constructions are known in which the space between the double walls of the side are covered off towards the bottom. This covering was effected also in the case of known drawers by means of a separately applied guide ledge, for instance with the part of the drawer guide which is to be fastened to the drawer with the opposite part thereof attached firmly to the body of the piece of furniture.

For molding reasons, freedom in design is limited in the case of single piece drawers. The doubling of the side walls and the provision of ribs and the like itself requires relatively expensive molds. Such molding is limited not only because multi part molds are difficult to manufacture and to control but also because, for instance, it is impossible in all cases to produce undercuts.

Another disadvantage of known constructions of single piece plastic drawers is that they excessively vibrate in response to mechanical blows because the large width bottom of the drawer acts to a certain extent as a membrane. Even if the side walls are strengthened to a certain extent by doubling and even if ribs are arranged between them, experience shows that it is not possible to avoid the "ringing" of such drawers.

In the case of single piece plastic drawers it is furthermore difficult to produce a sufficiently firm invisible attachment of the drawer to the front plate to which the handle is fixed. The customary connection of the drawer body by means of dowel pins molded thereon which are then fastened in corresponding dowel holes in the front facing has not always proved to stand up properly in use. Therefore, further types of attachments have also been used, for instance screws, which were fed from the inside through an end wall of the drawer into the front plate. These attachments are visible and thus are not only aeshetically disturbing but also the screw heads which lie against the front inner wall of the drawer easily become dirty and are difficult to keep clean. In drawers with so called full extension or double extension, it is know to extend the lateral guide ledges beyond the rear wall of the drawer somewhat, or lengthen their support, so that even when the drawer is pulled out fully and the rear wall of the drawer lies, for instance, in the same plane as the rest of the front wall of the article of furniture, the drawer is still reliably held. In this connection, however, the disadvantage has been noted in known drawer constructions that with the needed lengthened drawer guides it is not possible to avoid, both in the inserted condition of the drawer and in its fully extended position, a lateral movement or "flapping" of the drawer due to the play between the two parts of the opposed drawer guides.

SUMMARY OF THE INVENTION

An object of the present invention is to avoid the above discussed disadvantages of the known one piece drawers and to create a plastic drawer whose strength and stability is considerably greater than that of the known drawers and in which the front facing can be fastened in an invisible manner, and which, even when fully extended, does not permit lateral movement in its guides.

Briefly the invention contemplates a drawer of the above indicated type which is characterized by the fact that in the space between the double walls of the sides, there is inserted a ribbed ledge which has longitudinally staggered panels for resting alternately against the inside of the outer and inner walls. The panels are connected by transverse ribs and form, below an outside wall which is shorter than the inside wall, an insertion groove open towards the side. Inserted ribbed ledges advantageously occupy the space between the double walls completely up to the upper edge and rest thereagainst. The ribbed ledges may be attached by gluing or welding. Openings are arranged in the panels of the ribbed ledges. Directly below the lower edge of the outer walling of the double wall the ribbed ledges can protrude somewhat beyond the outer surface thereof.

In accordance with a variation of the invention, the ribbed ledges are provided, directly over the protruding part, with continuous or discontinuous longitudinal grooves and the outer walls are provided on their lower edge with inward protruding extensions for engagement in the grooves after the insertion of the ribbed ledges. The insertion grooves serve for the insertion of guide ledges of different shapes. The ribbed ledges are advisedly provided below the insertion grooves with a lower terminating box profile. Inward extending mushroom shaped extensions are advantegeously formed on the lower inner edge of the box profile and recesses are arranged on the inner walling extending down to below the bottom of the drawer, such recesses extending from the lower edge and their width corresponding to that of the stems of the mushroom shaped extensions.

The bottoms of the insertion grooves are preferably provided with openings or other developments for the form locked and/or holding reception of corresponding mating deformations on the inserted guide ledges. The guide ledges and/or the outer edges of the insertion grooves can be provided with deformations which interengage to serve as a dust seal. The side outer walls may also—commencing above the ribbed ledges—be provided, strongly spread out, shifted towards the outside in a flush manner, with a skirt which extends over the drawer guide.

On the front side of the drawer and the front edges of the ribbed ledges dowel-like protrusions are provided for the fastening of the front facing. Alternately the front side of the drawer can be provided with socket like protrusions whose bottoms, lying on a line with the wall are provided with predetermined breaking points. Dowels for the fastening of the front facing can be inserted into the sockets. The sockets may, however, also serve, in opposed pairs, for the fastening of a block with a dove tailed groove fitting therein being provided for attachment to the inside of the front facing. On the narrow side of the dove tailed groove there is preferrably provided a screw for the vertical adjustment and/or clamping of the ledge and thus of the facing.

Sockets arranged in pairs, one above the other, can also be provided with perpendicular continuous boreholes. In addition a plate used for attachment to the inside of the front facing is provided with extensions extending into the sockets which have continuous threaded boreholes aligned with the boreholes of the sockets to receive a continuous fastening screw or a fastening pin. A fitting part for attachment to the inside of the front facing may also consist of a plate with projections fitting into the sockets and an inwardly obliquely upward hook arranged alongside of the same as well as an identically shaped obliquely downward protruding hook having a height which is adjustable with respect to the front side of the drawer, in a guide by means of a set screw. The sockets can also be provided with internally threaded parts which are glued or welded therein.

The lower part of the ribbed ledges in which the insertion grooves are developed protrudes beyond the rear edge of the drawer and in the region of the protrusion an outwardly acting adjustment screw is arranged on the bottom of the insertion groove. The front outer parts of the inserted guides are slightly bent inwards from the insertion grooves.

By the use of ribbed ledges in the space between the double side walls of the drawer there is not only obtained a particular stiffening of these side walls but also the connection of the inserted ribbed ledges with the inner surfaces of the double walls is considerably improved by the flush application at the panels between the ribs of the ribbed ledge so that optimum improvement in strength and stability is obtained for the side walls in combination with the inserted ribs. On the other hand a very strong coherence and a damping and practically complete extinguishing of vibrations is obtained as a result of the flat surface resting against the panels between the ribs. Of course, in this way the strength of the connection between the drawing guide is also considerably improved. By the creation of the insert groove which is open towards the side it is possible to insert and apply practically all different systems of drawer guides, namely both the simplest as well as the most complicated double extensions with ball bearings or rollers which are offered on the market. The mounting of the ribbed ledges on the drawer is greatly facilitated by the development with interengaging form locked protrusions and can even be carried out automatically when there is a correspondingly large number of drawers. The additional gluing or welding in the region of the ribs and panels still further increases the strength. By merely the form locked connection between ribbed ledge and drawer, displacement of the drawer with respect to the ribbed ledges, for instance in the case of strong acceleration or sudden retardation in the movement of the drawer upon the closing or opening of it is reliably prevented. By the possibility of inserting the drawer guides in the insertion groove and the provision of an adjusting screw in the rearward protruding part of the insertion groove, the possibility is afforded for the guide parts or guide ledges to be placed bent or somewhat obliquely with respect to each other in the front and rear parts, so that both in the closed condition and in the furthest extended position of the drawer there is certain mutual bracing of the guide ledges by which play is eliminated and lateral movement of the drawer in these positions is prevented, namely "flapping" of the drawer is effectively avoided.

As a result of the invisible attachment of the front facing, not only is there obtained the advantage of improved appearance but, in particular, there is also retained an advantage which is particularly important and valued in such single piece drawers, namely the possibility that such drawers are by their very nature clean as a result of their development and can also be more readily kept clean.

BRIEF DESCRIPTION OF THE DRAWING

Other objects, features and advantages of the invention will be apparent from the following detailed description when read with the accompanying drawings which show by way of illustration and not limitation the presently preferred embodiment of the invention.

In the drawing.

DESCRIPTION OF THE PREFERRED EMBODIMENTS

Figure 1:
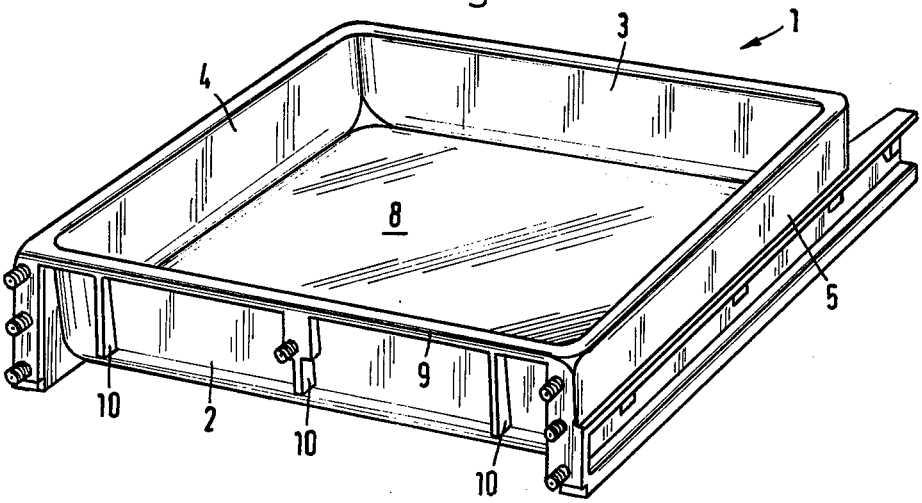
FIG. 1 shows in perspective a drawer in accordance with the invention.

A drawer member 1, which is produced in one piece by injection molding, has a front side 2, a rear wall 3, and sides 4 and 5 which are upwardly extending from bottom 8 and also connected as one piece to each other at the corners. In this way it is possible, both at the edges between the bottom 8 and the vertical sides as well as at the upper edge of the sides, to have well-rounded edges, which results in various advantages. On the top edge of the front side 2 there is provided a reinforcement 9, while on the front surface of the front side 2 there are also provided reinforcing ribs 10.

Figure 2:
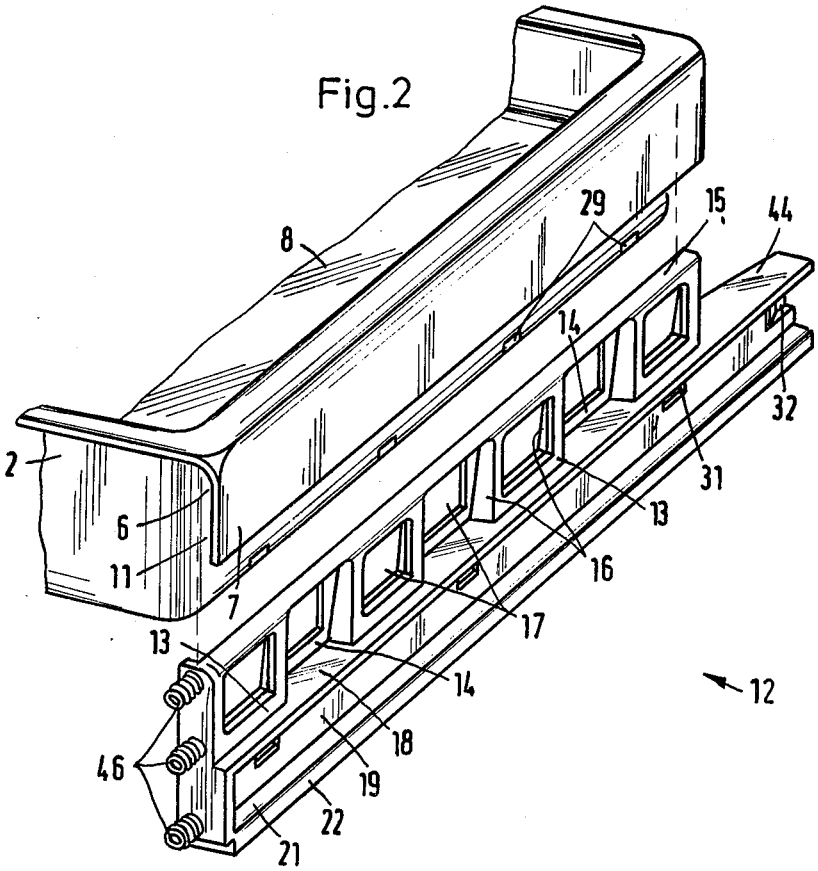
FIG. 2 shows, also in perspective, the side of the drawer with the ribbed ledge to be inserted, shown separately below it.

At least the sides 4 and 5 are formed of an inner side wall 6 and an outer side wall 7 surrounding an intervening space 11 (see FIG. 2) which space is open towards the bottom. In the embodiment shown in FIG. 1, the rear wall 3 is developed in the same manner. In the case of the sides 4 and 5, the outer side walls 7 are shorter than the inner side walls 6.

The space 11 is bounded by a smooth surface, no ribs requiring expensive molds being developed there. A ribbed ledge 12 is provided in its upper part with longitudinally staggered panels 13 and 14, the outer surface of the panels 13 resting against the inner surface of the outer side wall 7 after insertion, and the outer surfaces of the panels 14 lying, after insertion, against the inner surfaces of the inner side walls 6. At their upper edges, the panels 13 and 14 are provided with a straight continuous arm 15 which is rounded on its top and is adapted to abut the upper edge of the space 11. Between the staggered panels 13 and 14, narrow connecting walls forming ribs 16 are provided in the vertical plane perpendicular to such panels. Openings 17 are provided in the panels 13 and 14.

Figure 3:
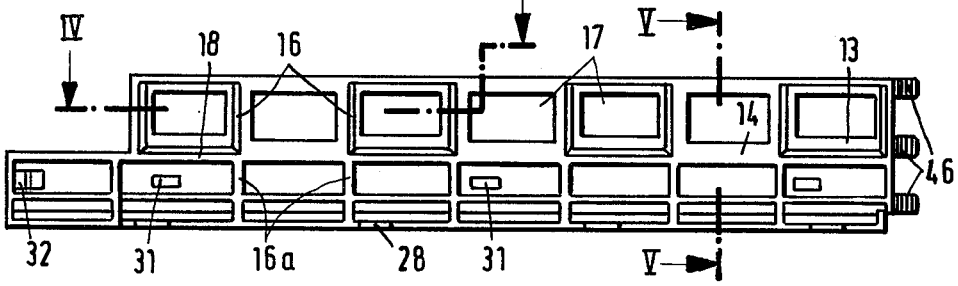
FIG. 3 is a side view of the ribbed ledge.

The outer side wall 7 is shorter than the inner side wall 6. The staggered panels 13 and 14 extend only over this upper region of the outer side wall 7 and the inner side wall 6, while the ribs 16 on the inside of the ribbed ledge 12 are continued to approximately the lower edge of the inner side wall 6. As seen in FIG. 3 the continuation 16*a* of the ribs on the inner side of the ribbed ledge 12 is separated by a longitudinal cross piece 18 from the upper part of the ribbed ledge bearing the ribs 16.

Figure 4:
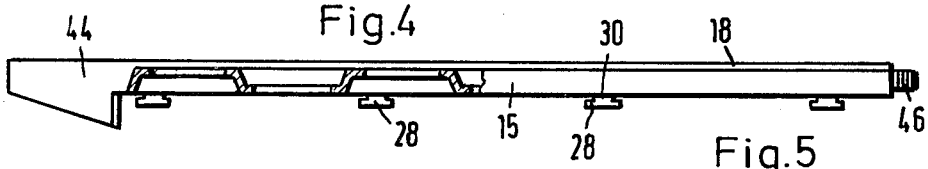
FIG. 4 is a top view of the ribbed ledge, partially in section along the line IV—IV of FIG. 3.
Figure 6:
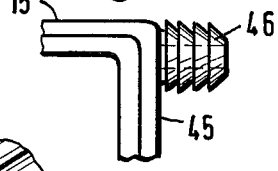
FIG. 6 is an enlarged partial view of the front end of the ribbed ledge.
Figure 5:
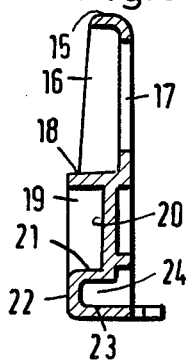
FIG. 5 is a cross section through the ribbed ledge along the line V—V of FIG. 3.

This longitudinal cross piece 18 forms the top of the lower part of the ribbed ledge 12. In this lower part there is developed an insertion groove 19 which is open towards the side and the bottom 20 of which (FIG. 5) is displaced outwards only slightly with respect to the inner panels 14 and on its inner side forms a continuous surface on which the lower parts 16*a* of the ribs are developed and from which they protrude. The insertion groove 19 is limited at the bottom by a cross member 21, which is also continuous in lengthwise direction and, by means of a downward extending wall part 22 which adjoins the same at right angles and the lower edge cross piece 23, forms a box like profile which surrounds an inwardly open through like space 24. Directly above the longitudinal cross member 18, grooves are formed in the panels 13, which grooves are formed either continuously or on individual panels and at their bottom preferrably have an upper right angle and are rounded at the lower side of their bottom. Opposite these grooves 25, ledge 26 having the same cross sectional shape as the groove 25 are formed on the inner lower edge of the outer side wall 7, see FIGS. 13 and 14. The inner side walls 6 are provided beyond the bottom 8 of the drawer and in the same plane as the latter with extensions which form ledges 27 for the level standing up and closing off of the body of the drawer. The inner edge of the lower edge cross piece 23 of the ribbed ledges 12 rests from the outside against the lower edge of ledges 27. Mushroom shaped protrusions 28 (FIG. 4) are formed, spaced apart from each other on the inner edge of the edge cross piece 23, and recesses 29 are provided opposite them in the ledges 27 on the body of the drawer.

Upon the insertion of the upper part of the ribbed ledge 12 into the space 11 between the inner side wall 6 and the outer side wall 7 of the drawer, the inward extending protrusions 26 on the inside of the lower edge of the lower wall 6 engage into the grooves 25 on the lower periphery of the outer panels 13, while the mushroom shaped protrusions 28 on the inside of the lower edge of the ribbed ledges are inserted, by means of their stems 30, into the recesses 29 on the lower edge of the ledge 27 of the body of the drawer. A form locked connection is thus produced between the ribbed ledge and the body of the drawer. Of course, it is advatageous also to glue or weld the panels 13 and 14 lying against the inside of the outer and inner side walls of the drawer to the drawer body at the places of application.

Figure 9:
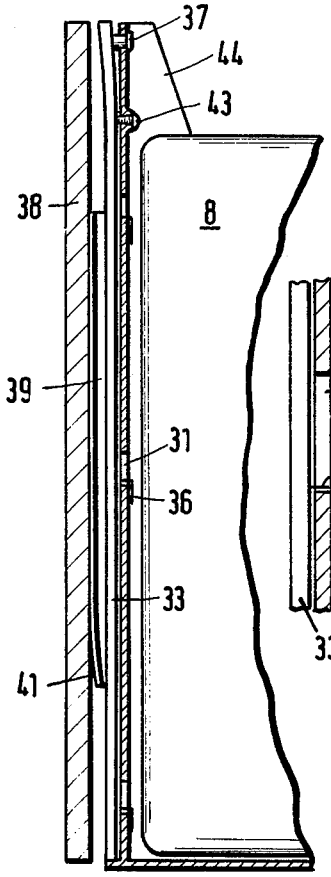
FIG. 9 is a horizontal longitudinal section through the insertion groove of the ribbed ledge with drawer guide inserted.
Figure 10:
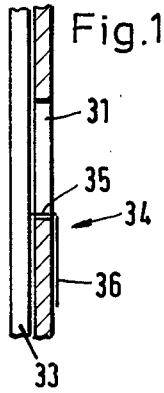
FIG. 10 is an enlarged showing of a portion of FIG. 9.

The base 20 of the insertion groove 19 (FIG. 5) is provided with a plurality of holes 31 (FIG. 3) lying lengthwise or spaced apart from each other and preferably having a rectangular contour. A vertically extending continuous slot 32 is preferably arranged in the vicinity of the rear end, at the bottom of the insertion groove. The parts of the drawer guides are to be inserted into the insertion groove 19 consist, in the ordinary commercial drawer guides which can be used for this purpose, of a rail 33 (FIGS. 13 and 14) which has, for instance a U-shaped profile and is formed out of sheet metal. On the base of this U-shaped profile tongues 34 (FIGS. 9 and 10) are punched out at intervals and bent twice, so that they first of all protrude from the rail 33 over a short part 35 and then have a further part 36 bent parallel to the rail 33. This part 36 is at most as long as the openings 31 on the bottom of the insertion groove 19. The rail 33 is inserted by means of such double bent tongues 34 into the openings 31 and then displaced in the insertion groove in such a manner that the parts 36 engage behind the wall of the ribbed ledge. In order to hold the rail 33 in this position in which it is fastened to the ribbed ledge, a protrusion 37 (FIG. 11) is arranged at the rear end of the ledge 34, fastened to another punching or in some other manner, such protrusion engaging into the slot 32 in the bottom of the insertion groove in the position of the rail 33 in which it is pushed forward and connected in form locked manner with the ribbed ledge, thus effectively preventing the pushing back and loosening of the rail. The protrusion 37 may, for instance, be in the form of a threaded screw or rivet and be substantially longer than the depth of the slot 32. It can be seen that in view of the space available, practically all common commercial drawer guides can be inserted into the insertion groove 19, namely both very simply developed guide rails as well as guide rails for roller extensions and double extensions.

Figure 13:
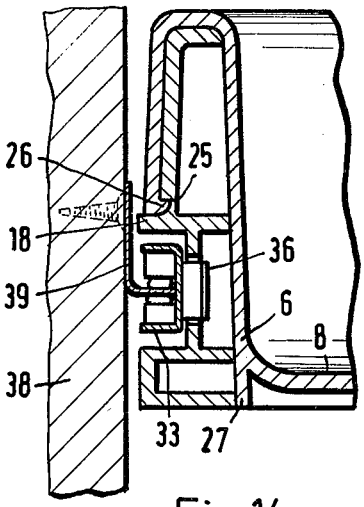
FIG. 13 is a vertical cross section through the side wall of the drawer with ribbed ledge and guide inserted.
Figure 14:
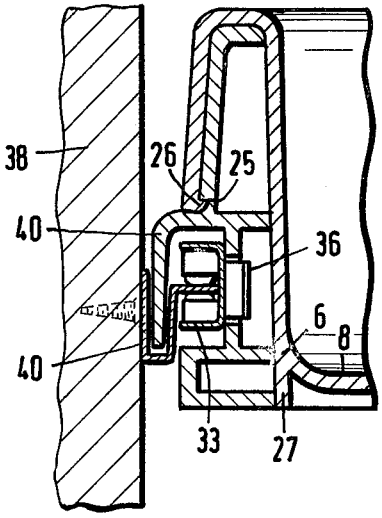
FIG. 14 is another embodiment in the sectional view shown in FIG. 13.

The guide rail which is to be connected with the body 38 of the article of furniture can, for instance, be developed as a single angle rail 39, as shown in FIG. 13, but it can also be of more complicated shape, for instance that shown in FIG. 14. In the latter figure, the guide rail 40 has a U-shaped profile with an inwardly directed guide web which engages into the U-shaped profile of the rail 33 arranged on the drawer. With this embodiment, it is possible to develop on the side of the drawer a skirt 40 which extends over the insertion groove and the guide strips and protects them from dirt. In the embodiment shown in FIG. 14, the skirt 40 is formed below the lower edge of the outer side wall 7 on the outer edge of the longitudinal cross member 18. Of course, the skirt may also possibly be developed, with corresponding outward displacement, on the lower edge of the outer side wall 7.

Figure 11:
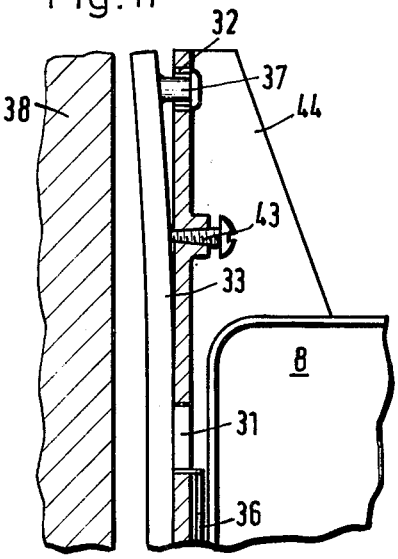
FIG. 11 is an enlarged showing of the rear end of the guide of FIG. 9.
Figure 12:
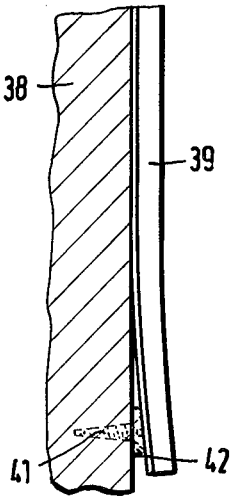
FIG. 12 is an enlarged showing of the front end of the guide of FIG. 9.

In order effectively to avoid a "flapping" of the drawer, namely lateral movement in the closed as well as in the extended position, the guide rail 39 or 40 which is connected with the body 38 of the article of furniture is provided at its front end with a spreading screw 41 (FIG. 12) which is preferably provided directly below its screw head, with a collar 42 and is inserted in a slot, open towards the front end, which has a width equal to the diameter of the screw 41, in the front end of the rail 39. By means of this screw 41, as can be noted from FIG. 12, the front end of the rail 39 can be spread somewhat from the body 38 so that it lies closer to the drawer and thus to the guide rail 33 arranged on the drawer. The guide rail 33, which is connected with the drawer, is pressed outward at its rear end by a spreading screw 43 (FIG. 11). This rail 33 thus also has its rear end bent off somewhat from the insertion groove 19 towards the facing guide rail which is seated in the body of the article of furniture. For this purpose, a special seat for the spreading screw 43 is provided in the part 44 of the ribbed ledge which is extended beyond the rear wall 3 of the drawer, and the pressing tongue or rivet 37 which prevents displacement of the strip 33 in the insertion groove is lengthened so that it has mobility in the slot 32 at right angles thereto. By this development of the guide ledges with spreading at the front end in the case of the guide strip which is fastened to the piece of furniture and spreading at the rear end in the case of the guide strip which is fastened to the drawer, lateral movement of the drawer is definitely prevented in its furthest open position and lateral movement in the inserted position of the drawer can at least be greatly reduced. By the provision of the adjusting screws or spreading screws 41 and 43 it is possible to establish and adjust the spreading of the corresponding guide rails in the desired fashion upon the insertion of the drawer.

By the extension of the insertion groove 19 beyond the rear end of the drawer, the guide strips can be securely fastened to the drawer in the part extending beyond the rear end of the drawer and anchored therein so that even when the drawer is completely pulled out and therefore the rear wall 3 lies approximately in the plane of the front of the piece of furniture, the drawer is still securely held and guided, and the guides can be supported in the insertion groove and the protruding part need not alone take up the entire load of the drawer.

Figure 7:
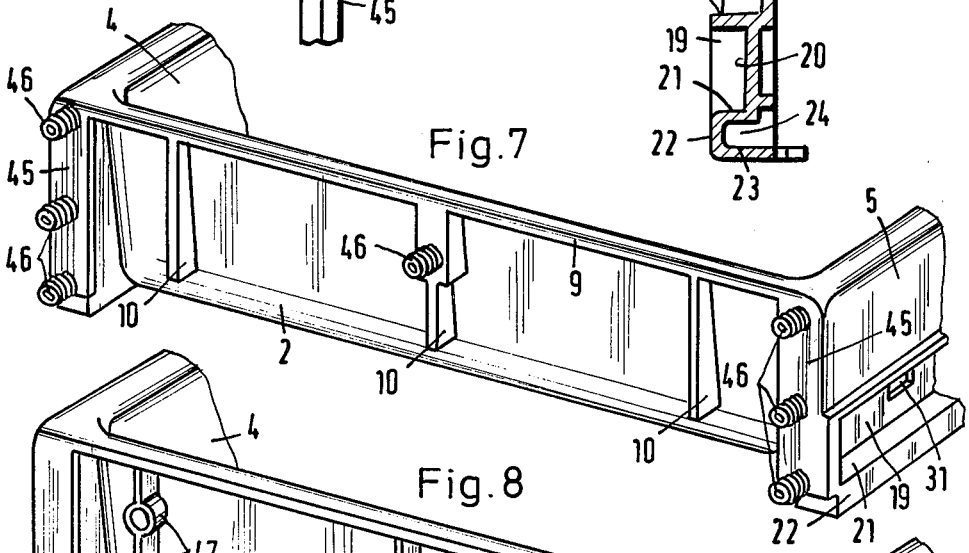
FIG. 7 is a perspective view of one embodiment of the front side of the drawer.

On the front end of the ribbed ledge 12 (FIG. 7) there are provided vertical front walls 45 which close off toward the front and limit the space 11 between the inner and outer side walls and lie in the same plane as the outer front edge of the reinforcement 9 on the front side of the drawer. Dowels 46 can be developed on these front walls 45 for attachment to a front facing in the known manner; it is then advisable to develop one or more dowels 46 on at least one of the reinforcing ribs 10 on the front side 2 of the drawer for attachment to the front facing.

Figure 8:
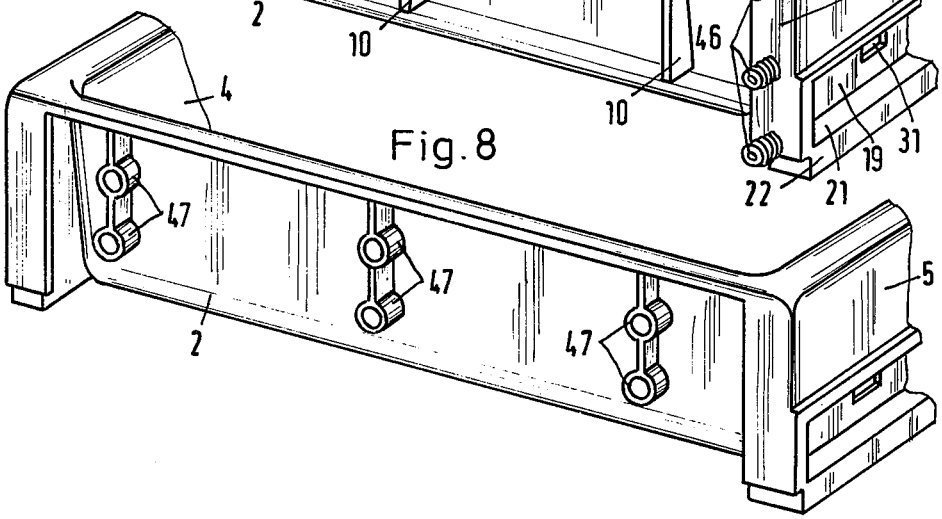
FIG. 8 is a perspective view of another embodiment of the front side of the drawer.
Figure 17:
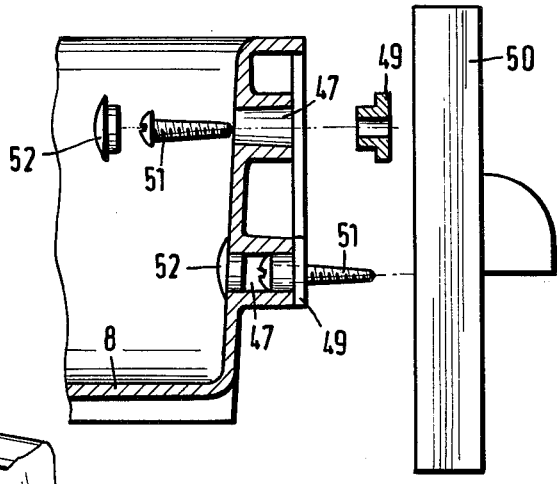
FIG. 17 is a vertical section through the front side of the drawer showing a different application of the attachment of the front facing.

In accordance with FIG. 8, the front walls 45 of the ribbed ledges 12 are smooth and therefore an additional protrusion in the form of sockets 47 is provided on the ribs 10 which are developed on the front side 2 of the drawer. The bottom of the sockets 47 (FIG. 15), which lies in the same plane of the front side 2 of the drawer, is advisedly provided with a predetermined place of break 48 in the form of a sharp groove which continues the inner surface of the socket 47 into the material of the front side. In accordance with FIG. 17, if the bottoms of the sockets 47 to be broken at the predetermined points of break, screw guides 49 are then glued or welded separately from the outside into said sockets 47 and the front facing 50 is fastened from the inside of the drawer by screws 51 through the sockets. The holes produced in the inside of the drawer on its front can be covered with suitable covering caps 52.

Figure 15:
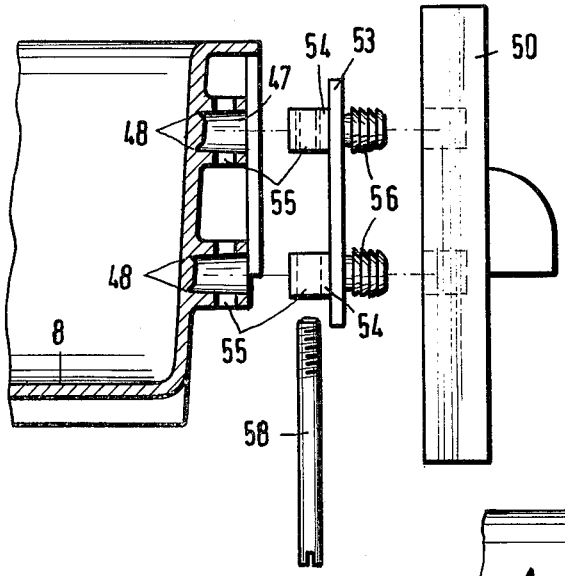
FIG. 15 is a vertical section through the front side of the drawer showing the application of the front facing.
Figure 16:
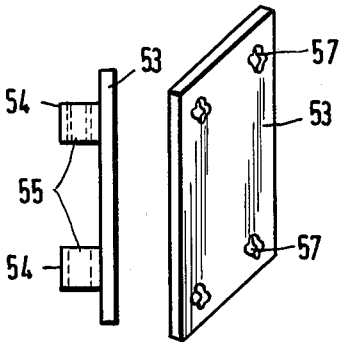
FIG. 16 is a modification of the attachment fitting of FIG. 15.

In accordance with another embodiment for the attachment of the front plate 50, a separate fitting part with dowels in accordance with FIG. 15 is provided in two different ways. This fitting consists of a plate 53 on which cylindrical protrusions 54 are formed for insertion into the sockets 47. Sockets and protrusions 54 are provided with a perpendicularly extending borehole 55, the borhole in the uppermost projection 54 being provided with an internal thread. Dowels 56 can be formed on the plate 53 opposite the protrusions 54 for fastening the front plate 50, as shown in the left hand side of FIG. 15; cross shaped holes 57 can also be provided on the plate 53 for attachment to the front facing 50 by means of screws which, before their final tightening, permit a lateral or vertical adjustment of the front facing 50 with respect to the fitting and thus with respect to the drawer.

The fastening or the cylindrical projections 54 and thus of the front facing 50 to the drawer is effected in the manner that these projections are first of all inserted into the sockets 47 and a threaded pin 58 is then inserted from below through the vertical boreholes 55 and screwed tight in the thread of the upper borehole.

Figure 18:
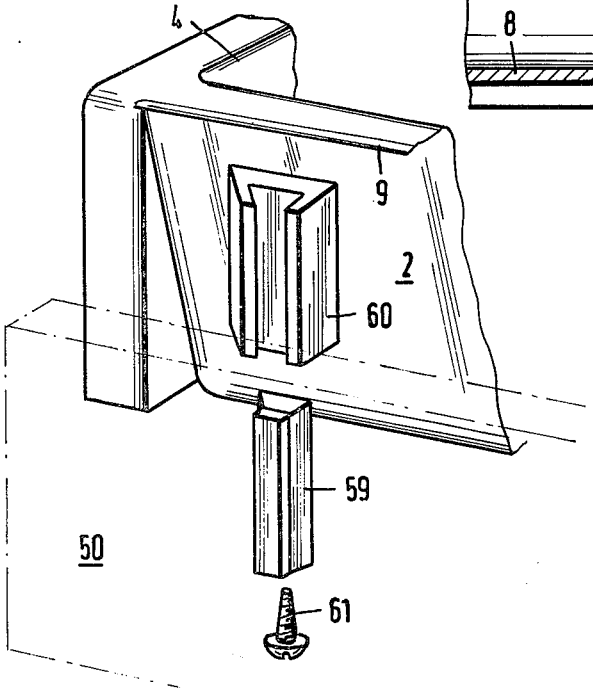
FIG. 18 is a perspective view of another embodiment for the application of the front facing.

In accordance with another embodiment, corresponding to FIG. 18, the front facing 50 is provided with a dove tail shaped ledge 59 on its inner side and a dove tailed groove 60 is formed on the front side 2 of the drawer to receive the dove tailed ledge on the front facing 50. By means of a screw 61, which is adapted to be screwed from below into the dove tailed ledge 59 the latter can be spread with respect to the dove tailed groove 60 and also displaced to a certain extent for vertical adjustment.

Figure 19:
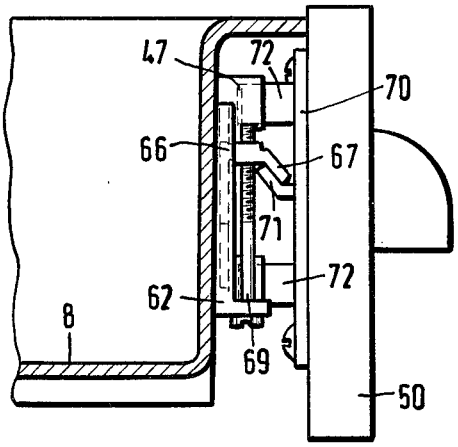
FIGS. 19, 19*a* and 19*b* are views, in part in section and in part in perspective, of another fastening fitting for the front facing.
Figure 19B:
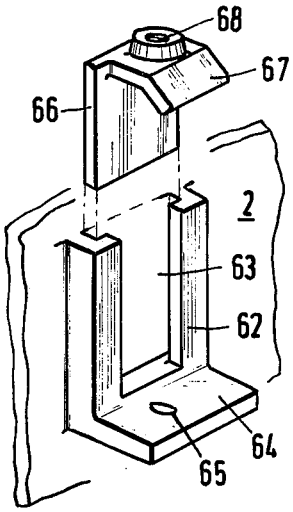
Figure 19A:
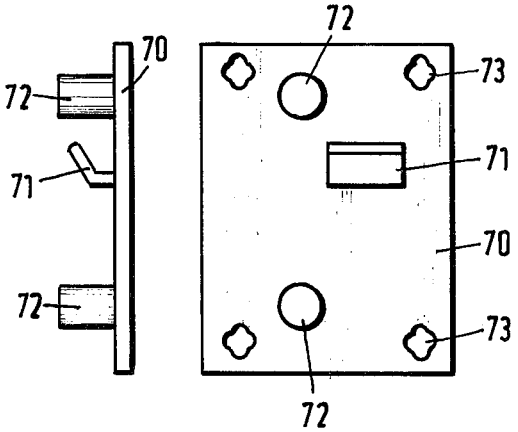

Another possible manner for connecting the front facing 50 with the drawer is shown in FIG. 19. In this case a fitting part 62, which is adapted to be fastened on the front side 2 of the drawer or developed thereon, is provided with a guide groove 63, which may be developed, for instance, in the shape of a T groove. At the lower end of this fitting 62, a projection 64 provided with a borehole 65 protrudes at right angles. Within the groove 63 an obliquely downward projecting wide hook 67 is guided in vertically displaceable manner via a corresponding guide part 66, such hook also having a borehole 68 which is coaxial to the borehole 65 and is provided with an internal thread. Through the borehole 65 there is inserted a screw having a long shank, the threaded part of which engages into the internal thread of the borehole 68. The hook 67 is adjustable in its guide by means of this screw.

Opposite the hook 67 on the front facing 50 an obliquely upward protruding hook 71 is developed on a plate 70. Cylindrical projections 72 are also formed on the plate 70 for insertion into the sockets 47 on the front side 2 of the drawer. In addition, cross shaped holes 73 are also provided in the plate 70 for the attaching of the front facing 50 in the manner which has been described in further detail above. After the fastening of the plate 70 to the front facing 50, the projections 72 of the front facing are inserted into the sockets 47 and, by tightening the screw 69, the movable downward protruding hook 67 is pulled over the obliquely upward protruding hook 71 on the front facing so that the two hooks engage with each other, as shown in FIG. 19, so that the front facing 50 is held firmly and securely to the drawer.

While only a limited number of embodiments of the invention have been shown and described in detail, there will be obvious to those skilled in the art, many modifications and variations satisfying many or all of the objects of the invention without departing from the spirit thereof as defined by the appended claims.

I claim:

1. A drawer assemblage comprising: a single piece drawer member having a bottom, front and rear walls extending upwardly from said bottom, and first and second sides extending upward from said bottom, each of said sides being formed of an inner wall extending from said bottom and a shorter outerwall parallel to said inner wall and connected to the top thereof; and a ribbed ledge member extending longitudinally in the space between each pair of inner and outer walls, each ledge member comprising a plurality of horizontally spaced vertical ribs, a panel between each pair of ribs, every other panel abutting the inner wall and the remaining panels abutting the outer wall of the pairs, and means for defining a horizontally extending insertion groove positioned below said panels and below the bottom of said outer wall, said groove facing away from said drawer member.

2. The drawer assemblage according to claim 1 wherein the ribbed ledge members completely fill up the space between the pairs of walls up to the upper edge thereof and rest against said edge.

3. The drawer assemblage according to claim 1 wherein the ribbed ledge members are fixedly connected to said drawer member.

4. The drawer assemblage according to claim 1 where said panels are provided with openings.

5. The drawer assemblage according to claim 1 wherein portions of the ribbed ledge members extend below the lower edge of the outer walls and protrude beyond the outer surface of said outer walls.

6. The drawer assemblage according to claim 1 wherein the ribbed ledge members are provided with a protruding longitudinal arm having longitudinal grooves, and the outer walls have inward extending projections on their lower edge for engagement into said grooves.

7. The drawer assemblage according to claim 1 wherein the insertion grooves are developed for accepting guide ledges of different shape.

8. The drawer assemblage according to claim 1 wherein below the insertion grooves there are provided ribbed ledges with a lower box profile.

9. The drawer assemblage according to claim 8 wherein inwardly projecting mushroom-shaped extensions are formed on lower inner edge of said box profile and recesses are arranged from the lower edge on the inner wall which is extended to below the bottom of the drawer and has the shape of a ledge, the width of said recesses corresponding to the stems of the mushroom shaped projections.

10. The drawer assemblage according to claim 7 wherein the insertion grooves are provided with means for receiving corresponding mating formations on said guide ledges.

11. The drawer assemblage according to claim 10 wherein said at least one guide ledge and said means for defining the insertion grooves are provided with mutually overlapping formations as dust seals.

12. The drawer assemblage according to claim 11 wherein the outer walls are provided with skirt means which extends over the drawer guide.

13. The drawer assemblage according to claim 1 further comprising a front facing, dowel shaped protrusions for the fastening of the front facing on the front wall of the drawer member and on the front ends of the ribbed ledge means.

14. The drawer assemblage according to claim 13 wherein the protrusions on the front wall of the drawer member are developed as sockets each having a bottom which, lying in the plane of the wall, is provided with predetermined break points.

15. The drawer assemblage according to claim 14 further comprising dowel means for inserting into said sockets for the fastening of the front facing to the drawer member.

16. The drawer assemblage according to claim 14 wherein said sockets are disposed in pairs one above the other, a fitting having a dove-tail groove means fastened to said sockets, and a dove-tail ledge on said front facing which fits into said groove means.

17. The drawer assemblage according to claim 16 further comprising a screw disposed on a narrow side of the dove-tail groove means for the adjustment of the height and the clamping of the dove-tail ledge.

18. The drawer assemblage according to claim 16 wherein said sockets arranged in pairs one above the other are provided with perpendicular continuous bores and further comprising a plate provided for attachment to the inside of the front facing, said plate having projections which extend into the socket and being provided with also continuous threaded boreholes aligned with the socket boreholes for receiving a continuous fastening screw.

19. The drawer assemblage according to claim 14 further comprising a fitting part for attachment to the inside of the front facing said part comprising, a plate with projections which fit into the sockets and an inwardly obliquely upward protruding hook arranged alongside thereof, an identically shaped obliquely downward protruding hook which is vertically adjustable with respect to the front wall of the drawer member along a guide by means of an adjusting screw.

20. The drawer assemblage according to claim 14 wherein the sockets are provided with screw guides.

21. The drawer assemblage according to claim 7 wherein the lower part of the ribbed ledge members in which part the insertion grooves are formed have a protrusion which extends beyond the rear edge of the drawer member.

22. The drawer assemblage according to claim 21 further comprising an adjusting screw acting from the inside to the outside which is in the region of the protrusion on the bottom of the insertion groove.

23. The drawer assemblage according to claim 21 further comprising drawer guides, the front outer parts of the drawer guides being spread towards the inside with respect to the body of the furniture by means of an adjusting screw.

* * * * *